US006105506A

United States Patent [19]

Gangale

[11] Patent Number: 6,105,506

[45] Date of Patent: Aug. 22, 2000

[54] SABOT SLUG FOR SHOTGUN

[75] Inventor: Antonio C. Gangale, 307 Hillcrest Dr. NE., New Philadelphia, Ohio 44663

[73] Assignee: Antonio C. Gangale, New Philadelphia, Ohio

[21] Appl. No.: 08/935,877

[22] Filed: Sep. 23, 1997

[51] Int. Cl.[7] ..... F42B 14/06

[52] U.S. Cl. ..... 102/439; 102/448; 102/509; 102/516; 102/517; 102/521; 102/522; 102/523; 244/3.23

[58] Field of Search ..... 102/439, 448, 102/507–510, 514–517, 520–523, 430, 501; 244/3.23

[56] References Cited

U.S. PATENT DOCUMENTS

| | | | |
|---|---|---|---|
| 2,123,981 | 7/1938 | Whipple | 102/508 |
| 4,644,866 | 2/1987 | Sullivan . | |
| 4,655,140 | 4/1987 | Schirneker | 102/517 |
| 5,016,538 | 5/1991 | Sowash . | |
| 5,175,394 | 12/1992 | Sowash | 102/522 |
| 5,214,238 | 5/1993 | Young . | |
| 5,263,418 | 11/1993 | Dippold et al. | 102/521 |
| 5,361,701 | 11/1994 | Stevens . | |
| 5,404,816 | 4/1995 | Burri . | |
| 5,458,064 | 10/1995 | Kearns . | |
| 5,479,861 | 1/1996 | Kinchin . | |

*Primary Examiner*—Harold J. Tudor

[57] ABSTRACT

A sabot bullet having a jacket bullet body and a nonrotable sabot segments. The jacketed bullet has forward end portion, torso, and rear end portion. The forward end portion is constructed of multi-metals, having a tapered nose, hollow point with grooves to aid in the expansion. The torso is of solid single metal with outward tabs, which relates the slug when the sabot's external surface comes in contact with the rifling in the gun barrel. The rear portion a single metal with a rear cavity to reduce the over all weight and increase the ratio to the forward portion of bullet. A bullet embodiment with external rifling and an armor piecing sabot round is also disclosed.

6 Claims, 7 Drawing Sheets

SECTION VIEW

SECTION VIEW

FRONT VIEW

TOP VIEW

SECTION VIEW

TOP VIEW

BOTTOM VIEW

SIDE VIEW

SIDE VIEW

FRONT VIEW

SECTION VIEW

SABOT SLUG FOR SHOTGUN

BACKGROUND

1. Field of Invention

This invention relates to ammunition, in particular ammunition for use in conventional small arm weapons having smooth or rifled barrels.

2. Description of Prior Art

Conventional shotgun slugs have major weaknesses. The slug has limited distance and accuracy. The invention of the sabot improved the distance and accuracy, but compromised the "knock down power" of the projectile. Today's sabot (Sowash 5,016,538 May 21, 1991) has a tendency to drill through the animal without mushrooming. Since the projectile does not mushroom up effectively, this over penetration does not cause near the injury to the animal as do conventional slugs. Additionally, today's sabot slugs (Sowash 5,016,538 May 21, 1991 and Kinchin 5,479,861 Jan. 2, 1996) have a very poor aerodynamic design and lose a great deal of accuracy if not shot out of a rifled barrel. Conventional sabots have a plastic embodiment which rotates when passing through the rifling in the barrel or in the choke tube. When shot through a smooth bore barrel the slug fails to rotate. This leads to poor accuracy and shorter distance. This is a major problem to hunters who have smooth bore barrels. The majority of hunters use smooth bore barrels.

Therefore, the needs for a projectile with improved aerodynamics design, improved transfer of energy to the sabot, improved expansion increasing "knock down power" and the ability to be used in a smooth bore barrel is needed.

OBJECTS AND ADVANTAGES

The present invention incorporates several aspects depending on the weapon and the intended use of the round. The first aspect will relate to use on game animals, fired through a rifled barrel. The second aspect will relate to rounds used on game animals shot through a convential smooth bore shotgun barrel. The third aspect will relate to military use.

The first aspect of the present invention is to provide improved expansion while not compromising the strength of the bullet. The introduction of a jacket will allow this. A jacket has many benefits. A jacket will strengthen the bullet, and minimize the tendency for the body to break at the narrowest point. Also since the core of the projectile is solid, the chance of it fragmenting when bone structure is hit is very slim. Maintaining the bullet body as a whole is essential for accuracy, enabling for greater penetration into the target. Also, a jacket will allow the incorporation of a softer metallic material in the nose of the bullet. This will aid in the mushrooming of the bullet. The combination of metals will not only strengthen and maximize expansion but also will lighten the bullet, increasing the distance of the bullet.

Another improvement is an improved aerodynamic design. A streamlined front nose will decrease drag which will increase distance. Lengthening the projectile thereby stabilizes the bullet and prevents it from tilting off axes as it travels down the barrel. Stabilizing the projectile decreases fiction. In turn this allows the projectile to maintain more of its energy and also improves accuracy. Another feature of design is a hollow point. It is known that the use of a hollow point increases the "mushrooming effect" of a bullet. In doing so this increases the injury to the animal. Placing grooves on the front portion of the bullet will allow the bullet to mushroom in the "flower petal design" more easy. Still, another improvement is a hollow rear cavity that allows reduction of rear weight which increases the ratio of the front rear weight. The increase of front end weight which velocity and stability.

A further improvement in design is the nonrotation of the slug. In conventional sabots rifling in the barrel spins the bullet embodiment using frictional forces to then spin the slug. The disadvantage to this is that the sabot material must have a high coefficient of friction to maintain its grip on the projectile, with a correspondingly high friction loss in the barrel. Placing grooves or tabs on the projectile would mechanically engage the projectile spin, instead of just the use of frictional forces. This results in a lower coefficient of friction in the barrel, increasing the projectile's kinetic energy leaving the barrel. The bullet and the sobot are also rotating at substantially the same rate as the projectile travels along the gun barrel. It is desirable that the sabot rotates as the projectile travels along the length of the rifled gun barrel. Placing tabs in the torso where there will be less air movement, allows the bullet to remain streamline.

The implementation of a jacketed bullet, streamline design, hollow cavities, and grooves allows for a long range energy and accuracy. This long range energy and accuracy will enable the hunter near rifle applications.

The second aspect of the invention relates to when a round is used on game animals shot through a convential smooth bore barrel. Rifling will be placed on the bullet sabot. The rifling on the sabot imparts a certain amount of rotary motion to the bullet. As it passes through the barrel this rotary motion stabilizes it in flight, which is essential for accuracy and distance. The sabot will be made of a hard substance, such as an epoxy or other suitable material. The rifled sabot will be lubricated much like a rifle round.

The third aspect of the invention relates to an armor piercing round. Armor piercing is formed of a solid material such as copper, steel or a similar hard metal. This round will have a pointed nose with a straight tapered front end portion.

REFERENCE NUMBERS IN DRAWINGS

| | |
|---|---|
| 20 round | 22 shotgun case |
| 24 lower base | 26 cartridge |
| 25 primer pocket | 30 primer |
| 32 section | 34 power propellent |
| 36 wad | 38 crimp |
| 40 bullet | 42 sabot segments |
| 44 hollow point | 46 rear cavity |
| 48 tabs | 50 jacket |
| 52 lead | 54 tab groove |

-continued

| | |
|---|---|
| 56 gas seal | 58 torso |
| 60 grooves | 62 cavity insert |
| 64 rifling | 68 epoxy |
| 69 armor piercing | 70 front end portion |
| 72 pointed nose | 74 armor piercing sabot segments |

DETAILED DESCRIPTION OF THE PREFERRED EMBODIMENT

Figure 1:
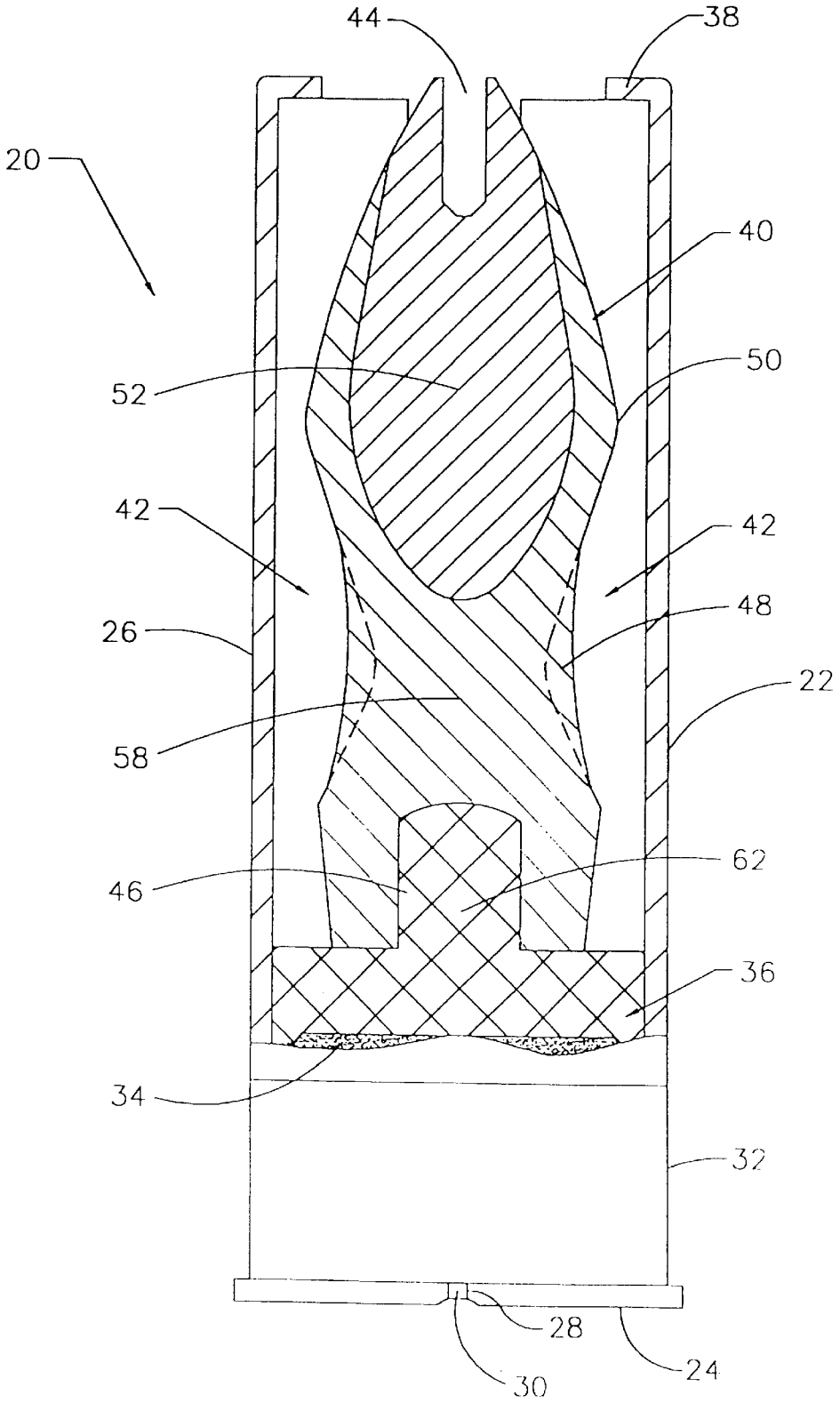
FIG. 1 is a section view of a conventional shotgun shell having the improved sabot bullet of the present invention mounted.

Referring more particularity to FIGS. 1–6*b* wherein like numbers refer to similar parts, a shotgun round 20 is shown in FIG. 1. The round 20 has a conventional shotgun case 22 which normally has a lower base 24 which is preferably constructed of brass as shown in FIG. 1, which maybe alternatively constructed of plastic and a flexible cartridge wall 26 constructed of plastic or treated paper. The round 20 will be assembled with the present invention having a bullet 40. A pair of sabot segments 42 make to embrace said bullet 40, and a wad.

In the base 24 of the cartridge is a primer pocket 28 with a primer 30 located therein. The section 32 of the shotgun case 22 directly above the primer 30 is filled with a powered propellent 34 which is overlain by a wad 36. On top of the wad 36 is a projectile 51 shown in FIG. 2. The projectile 51 is held in the shotgun case 22 by a crimp 38 shown in FIG. 1.

When the round 20 is fired in a shotgun, the firing pin of the shogun impacts the primer 30 which ignites the power propellent 34. The propellent 34 begins a rapid burning or deflagrations. It creates a high-pressure, high temperature gas which expands against the wad 36 and drives it toward the bullet 40 and sabot segments 42. The wad 36 performs several functions. In conventional shotgun wads, the wad would compress thereby allowing a gentle acceleration of the projectile. The design lengths of the bullet 40 would not allow for this feature. The wad 36 is designed with a rear cavity insert 62 which is therein the rear hollow cavity 46 of the bullet 40. The rear cavity insert 62 will direct force upward to the larger mass of the bullet 40 and reduce the sadden load on the weaker walls of the rear cavity 46, reducing the possibility of deformation of the bullet's rear cavity 46. The wad 36 also performs the function as a gas sew 56, to maximize chamber pressure in the gun.

The wad 36 and the projectile 51 are forced out of the shotgun case 22. According to the first aspect of the invention, the projectile 51 will be fired out of a rifled barrel, which has rifling to impart a rotary motion to the projectile 51 as it passes along the length of the gun barrel to the discharge end. The rotary is imparted to the projectile because the exterior surface of the projectile 51 is forced into contact with rifling. The projectile 51 with the bullet 40 and the sabot segments 42 are nonrotatably, connected with tabs 48. This mechanical connection allows the bullet 40 and the sabot segments 42 to rotate at the same number of revolutions per minute when exiting the barrel.

As shown in FIGS. 1–5 of the drawings, the bullet 40 has a forward end portion, a rear portion ad a torso 58 having a decreased diameter. The bullet 40 is generally cylindrical in lateral cross section. The forward end portion is formed with a tapered nose with a flair central region. The bullet 40 is then tapped inwardly from the central region of the forward portion to torso 58. The torso 58 starts at outwardly taper from about half where it begins a slight taper inwardly to the rear of the bullet 40. The forward end portion of the bullet 40 is hollow 44. The forward end portion of the bullet 40 is constructed of two materials, preferably lead and copper. The lead 52 will be jacketed 50 with preferably copper or other suitable materials. The forward end portion of the bullet 40 will have grooves 60 placed in the jacket 50. This will aid in the expansion, causing a "flower pedal" effect. The torso will be constructed of the same matter as the jacket 50. A pair of outward extending radial tabs 48 are located in the torso 58. The tabs 48 are spaced 180 degrees and each tab fits within a tab groove 54 formed in the sabot segments 42. This connection between the sabot segments 42 and the bullet 40 creates a mechanical engagement during travel along a gun barrel, as explained The rear portion constructed of the same material as the jacket 50 and torso 58 will have a hollow cavity 46. The center of gravity of the bullet 40 is positioned forwardly to the center of the geometric mass thereof The torso 58 and rear end portion constructed preferably of copper will aid a heaver forward weight.

Figure 2:
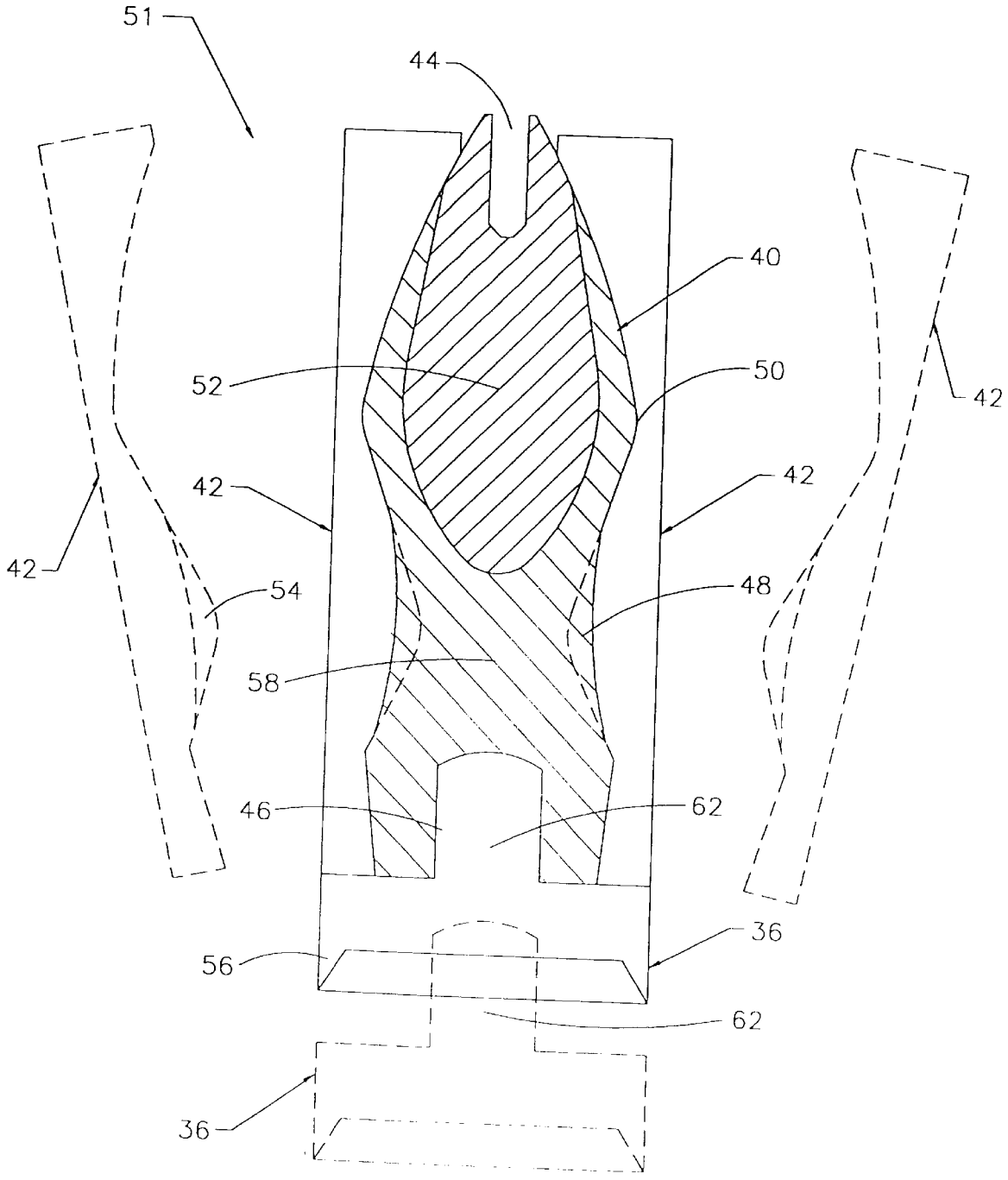
FIG. 2 is the section view of the improved sabot, the bullet, and the wad.
Figure 3:
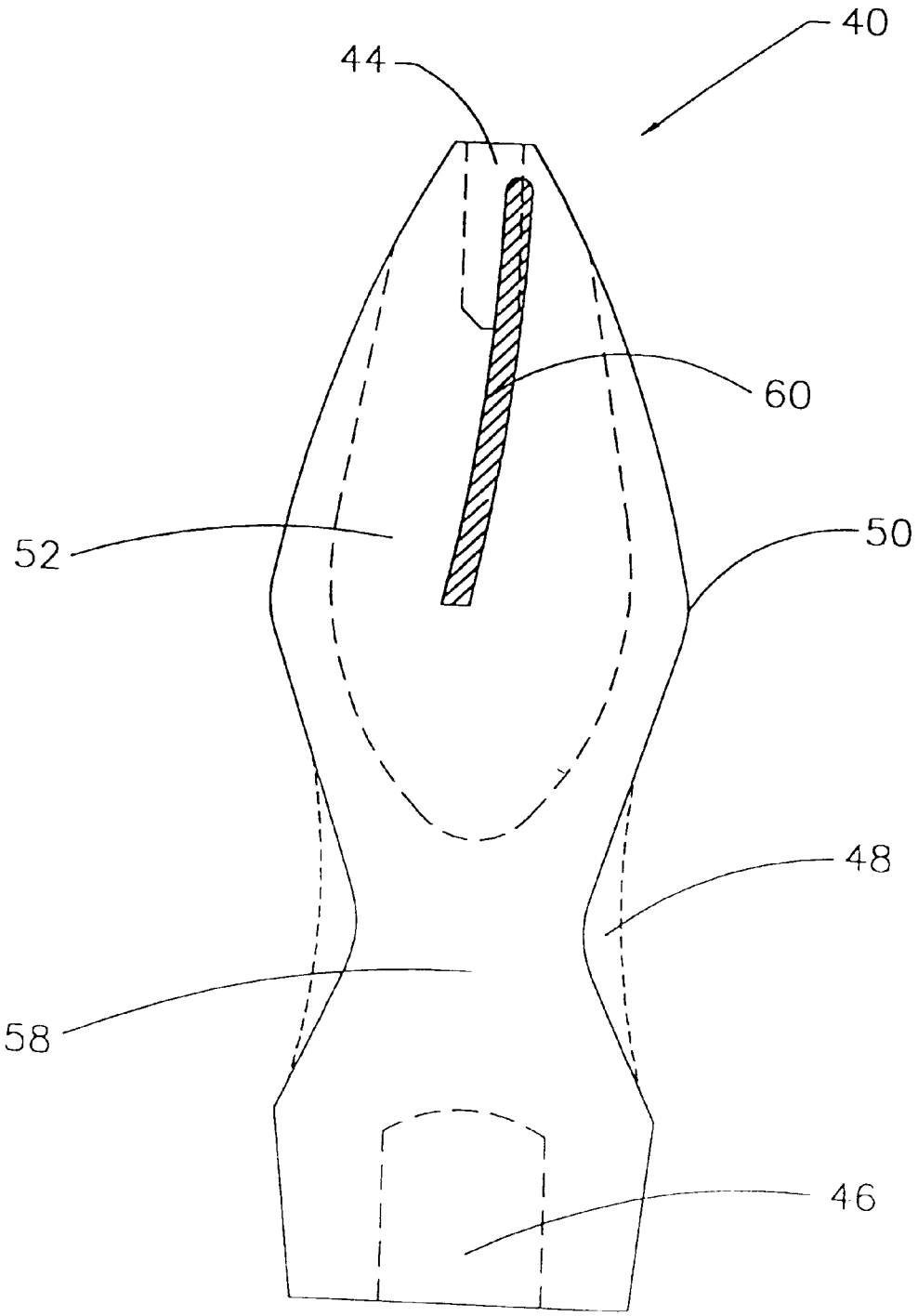
FIG. 3 is a front view of the improved bullet.
Figure 4:
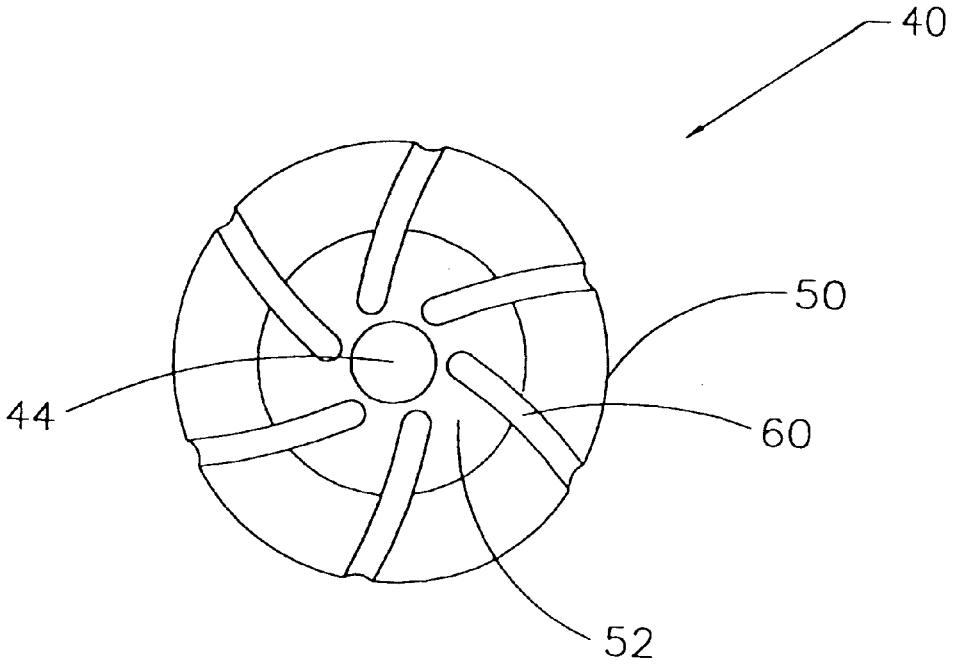
FIG. 4 is the top view of the improved bullet.
Figure 5:
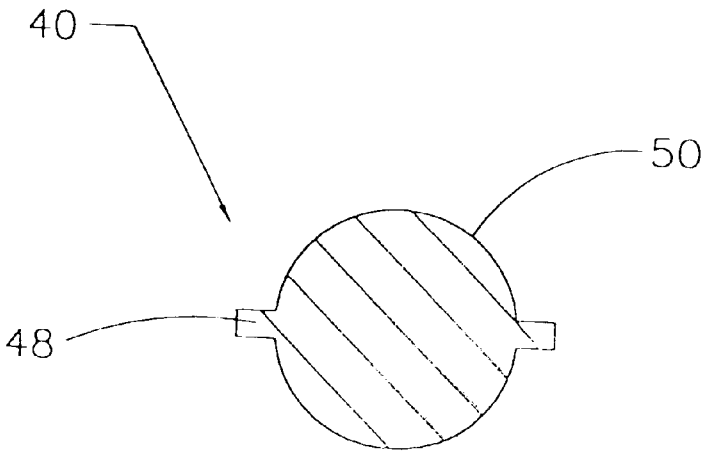
FIG. 5 is a section view of the torso of the improved bullet.

As shown in FIG. 1–2 of the drawings each of the sabot segments 42 extends about the bullet's 40 body for about half the circumference of the bullet's 40 body. Both sabot segments 42 have cylindrical outer which mate to present a cylindrical outer surface for the bullet. The cylndrical outer surface fits within the cylindrical inner surface of shotgun case 22. The inner surface of each of the sabot segments 42 matches and is complimentary to the adjacent outer surface portions of the bullet's 40 body. Each sabot segments 42 has a forward end portion, a torso were the tab groves 54 are located, and a rear portion.

Figure 6:
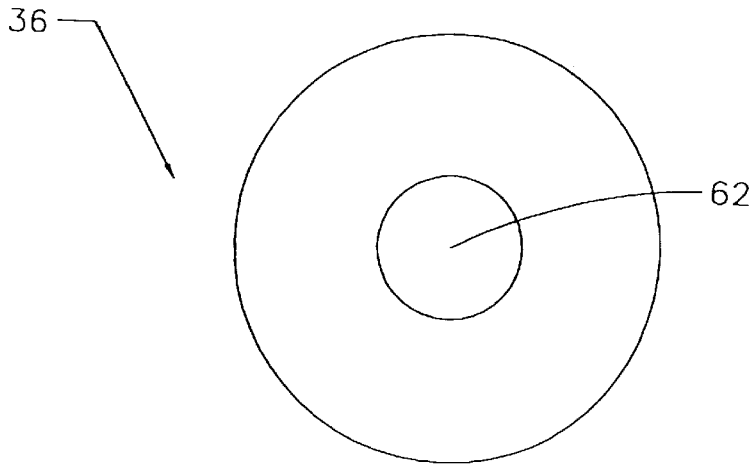
FIG. 6 is a top view of the wad.
Figure 6A:
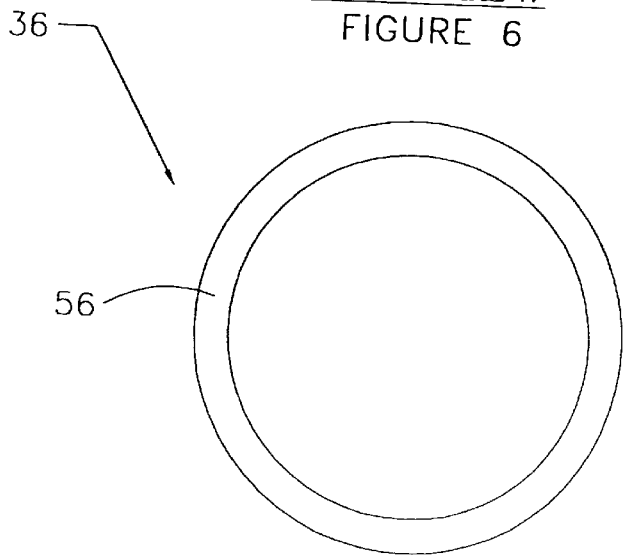
FIG. 6*a* is a bottom view of the wad.
Figure 6B:
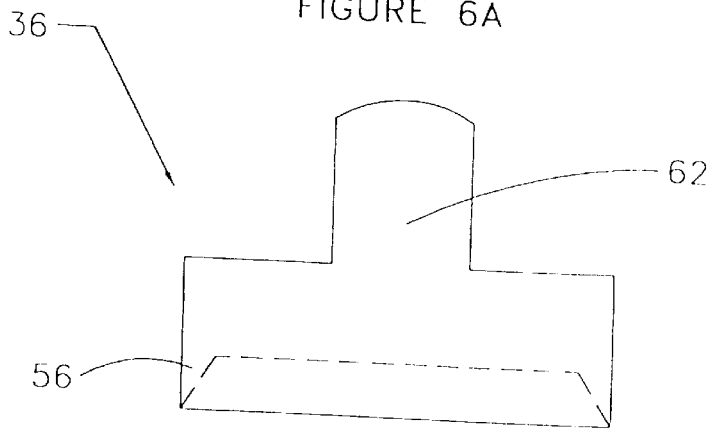
FIG. 6*b* is a side view of the wad.

As shown in FIGS. 6–6*b* of the drawings, the wad 36 is cylindrical in lateral cross section. The wad 36 has a forward end portion which is the rear cavity insert 62. The cavity insert 62 fits therein the rear portion of the bullet 40. The wad's 36 rear end portion has a larger diameter than the rear cavity insert. The walls of the rear portion taper inward forming a hollow rear cavity. The walls of the wad 36 act as a gas seal 56 when the round 20 is fired. The wad 36 is constructed of plastic or other suitable material for this use.

Figure 7:
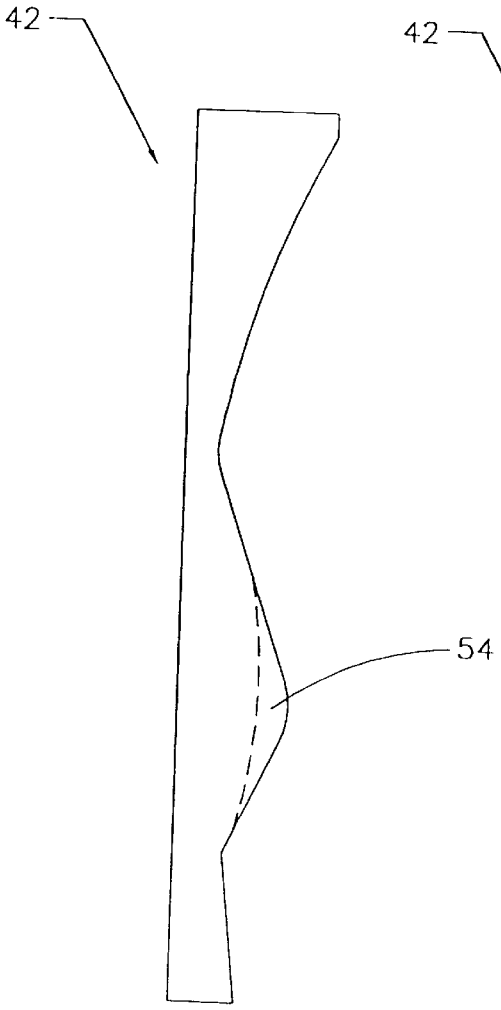
FIG. 7 is a side view of the improved rifled sabot segment.
Figure 7A:
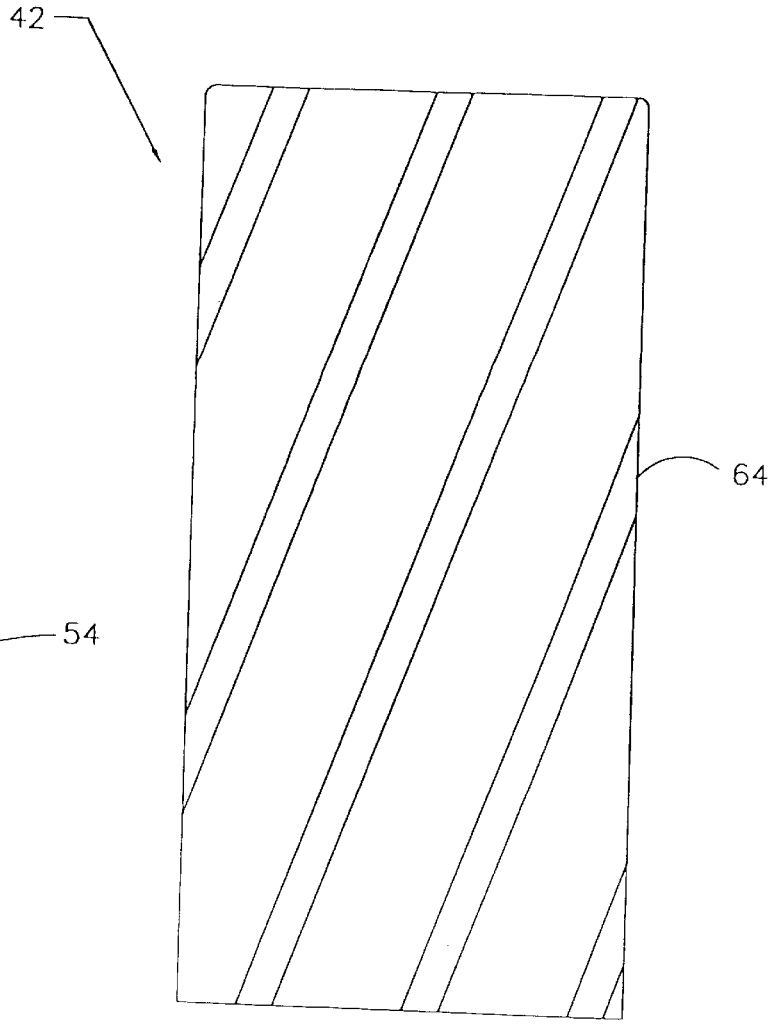
FIG. 7*a* is a front view of the improved rifled sabot segment.
Figure 7B:
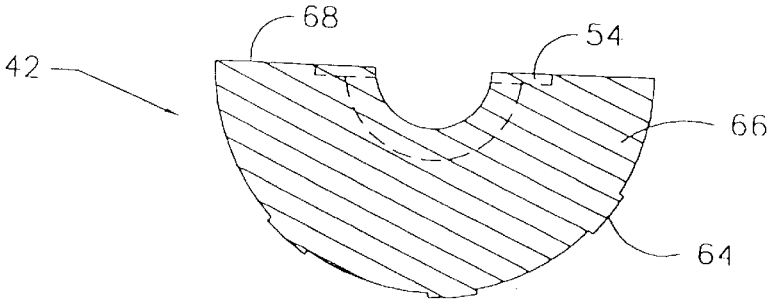
FIG. 7*b* is a section view of the improved rifled sabot segment.

The internal mobile rifling choke tube, the modified bullet embodiment, as shown in FIGS. 7–7*b* has sabot segments 42 explained hereinabove, but will be modified with longitudinal grooves, rifling 64. This rifling 64 has externally angled grooves placed on the outer surface of the sabot segments 42. In the same manner that rifling 64 is placed into choke tubes but inverted. This embodiment is intended for the use in unrifled smooth bored barrels to aid in the accuracy and performance of the weapon. This internal mobile rifled embodiment are preferable constructed of an epoxy 68 or other hard suitable material.

Figure 8:
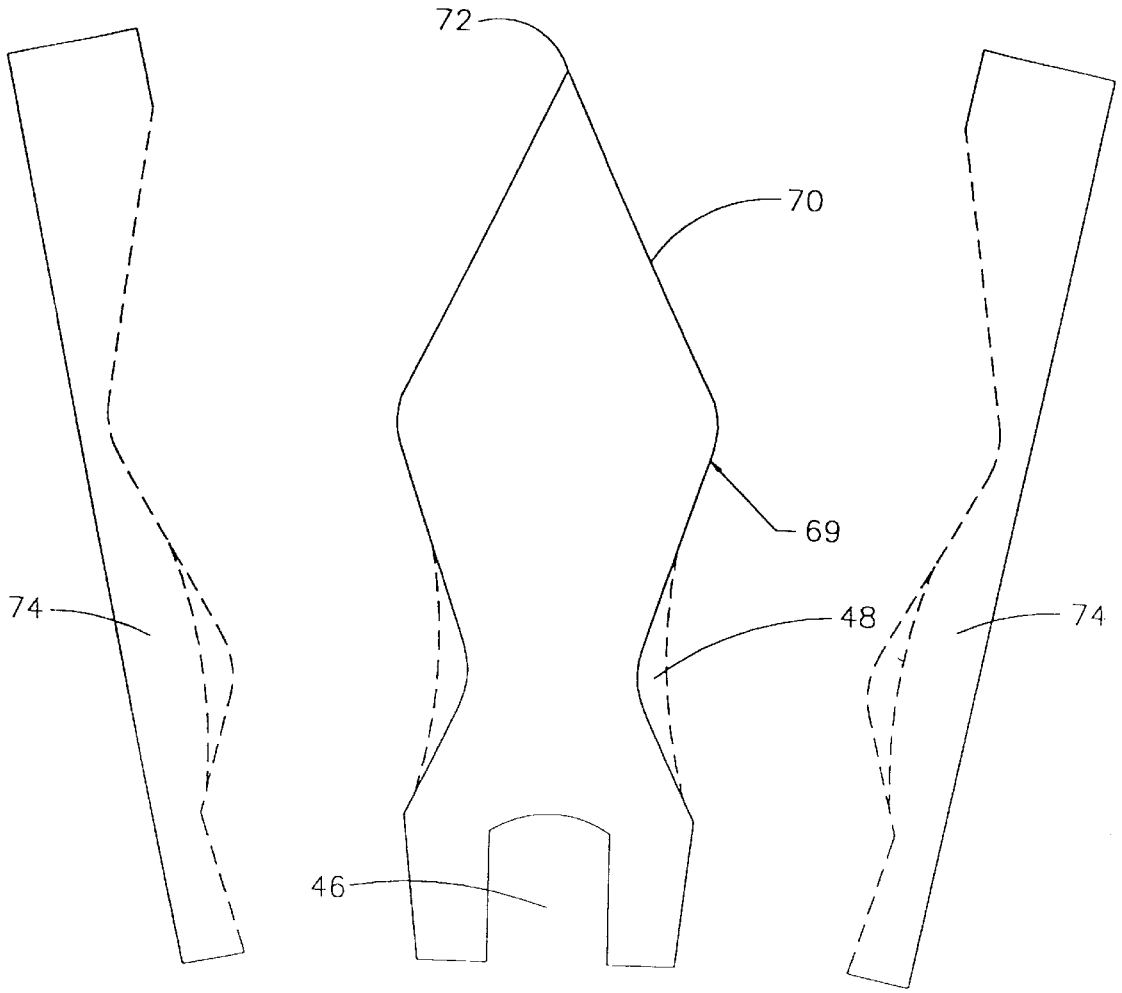
FIG. 8 is a section view of the armor piercing bullet.

The armor piercing sabot bullet 69 is shown in FIG. 8. The bullet 69 has a pointed front end 72 which is conical in configuration. The pointed front end 72 will be mounted to the torso 58 of the bullet 40 explained thereinabove. The armor piecing bullet 69 is formed from a suitable material such as copper or steel.

SUMMARY, RAMIFICATIONS, AND SCOPE

Accordingly, the reader will see that the sabot slug of this invention can be used by sportsmen with smooth and rifled barrels and by government agencies as an armor piercing round. The slug provides for an improved expansion, steamline design, improved transfer of energy, and improved distance.

Although the description above contain many specifics, these should not be construed as limiting the scope of the invention but as merely providing illustrations of some of the presently preferred embodiments of this invention. For example, the bullet can have other shapes, such as a a longer length, smaller diameters. The lead can be substituted with other material such as bismuth or new composite material having lower toxicities. Copper can be substituted with lighter materials such as a bended alumiman or titaninam, etc.

Thus the scope of the invention should be determined by the appended claims and their legal equivalents, rather than by the examples given.

I claim:

1. A cartridge, comprising:

an outer casing having a base, a lower casing section, a cartridge wall and a crimp, said base having a primer, said primer having a pocket filled with a propellant;

a cylindrical wad having a rear end portion, a rear cavity insert, said wad located within said outer casing, said rear cavity insert having a diameter, said rear end portion having a diameter larger than said rear cavity insert diameter;

a bullet having an outer jacket, a torso having a pair of outwardly extending radial tabs, a forward end portion, a rear portion having a rear hollow cavity, said torso tapered inwardly then outwardly toward said rear portion, said radial tabs being spaced 180 degrees apart from one another, said forward end portion having an inwardly tapered nose and a flair in a central region of said forward end portion, said forward end portion having a hollow portion and a plurality of longitudinally extending grooves within said jacket, said hollow portion of said forward end having a material body therein, said material having a hollow point extending downwardly toward said rear hollow cavity, said rear portion accepting said rear cavity insert of said wad, said bullet having a center of gravity;

a pair of cylindrical sabot segments each sabot segment extending halfway around the circumference of said bullet, said pair of sabot segments mating such that they create a cylindrical outer surface of said bullet, said sabot segments having inner surfaces which are complementary to surfaces of said bullet, said bullet and said sabot segments being non-rotatably connected to said radial tabs;

wherein said center of gravity of said bullet is positioned forwardly toward said forward end portion.

2. The projectile of claim 1 wherein said plurality of grooves comprises six grooves.

3. The projectile of claim 2 wherein said grooves are equidistant apart from one another.

4. The projectile of claim 1 wherein rifling is placed upon said sabot segments.

5. The projectile of claim 1 wherein said rear portion has a wall that tapers inwardly toward a rear end of said bullet.

6. A projectile, comprising:

a bullet having a torso, a solid forward end portion, and a rear portion having a rear hollow cavity, said torso having a pair of outwardly extending radial tabs and said torso tapering inwardly then outwardly toward said rear portion, said radial tabs being spaced 180 degrees apart from one another, said forward end portion having an inwardly tapered conical pointed front end; a pair of cylindrical sabot segments, each of said sabot segments extending halfway around the circumference of said bullet, said pair of sabot segments mating such that they create a cylindrical outer surface of said bullet and said sabot segments having inner surfaces which are complementary to surfaces of said bullet, and said sabot segments and said bullet being non-rotatably connected to said radial tabs.

* * * * *